US006353417B1

(12) United States Patent
Yuanzhu

(10) Patent No.: US 6,353,417 B1
(45) Date of Patent: Mar. 5, 2002

(54) PRIMARY RADIATOR IN WHICH THE TOTAL LENGTH OF DIELECTRIC FEEDER IS REDUCED

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/636,176

(22) Filed: Aug. 10, 2000

(30) Foreign Application Priority Data

Aug. 13, 1999 (JP) ..... 11-229366

(51) Int. Cl.[7] ..... H01Q 13/00
(52) U.S. Cl. ..... 343/785; 343/772
(58) Field of Search ..... 343/785, 786, 343/772, 840, 782, 781 R, 781 P, 781 CA; H01Q 13/00

(56) References Cited

U.S. PATENT DOCUMENTS 4,447,811 A * 5/1984 Hamid ..... 343/783
H584 H * 2/1989 Schwering et al. ..... 343/785
5,652,599 A 7/1997 Pitta et al. ..... 343/858
6,137,449 A * 10/2000 Kildal ..... 343/781 P
6,211,842 B1 * 4/2001 Cousin et al. ..... 343/840

FOREIGN PATENT DOCUMENTS

JP 10-256822 9/1998
WO WO 99/57804 11/1999

* cited by examiner

*Primary Examiner*—Hoanganh Le
(74) *Attorney, Agent, or Firm*—Brinks Hofer Gilson & Lione

(57) ABSTRACT

A primary radiator has a dielectric feeder at an open end of a waveguide in which the total length of the dielectric feeder is reduced. The dielectric feeder includes a holding portion forced into the interior of the open end portion of the wave guide and a radiation portion protruding outwardly from the open end of the wave guide, at least one recess being formed in each end surface of the two portions. The recess includes a stepped hole composed of a large diameter cylindrical hole and a small diameter cylindrical hole connected to the bottom surface thereof, the depth of each cylindrical hole being approximately ¼ of the wavelength $\lambda\epsilon$ of the radio wave propagated through the dielectric feeder.

24 Claims, 3 Drawing Sheets

PRIMARY RADIATOR IN WHICH THE TOTAL LENGTH OF DIELECTRIC FEEDER IS REDUCED

BACKGROUND OF THE INVENTION

1. Field of the Invention

The present invention relates to a primary radiator provided in a satellite receiving reflective antenna or the like and, in particular, to a primary radiator using a dielectric feeder.

2. Description of the Related Art

FIG. 6 is a sectional view of a conventional primary radiator using a dielectric feeder. This primary radiator comprises a wave guide 1 one end of which is open and the other end of which is formed as a closed surface e 1. Inside the wave guide 1, a first probe 3 and a second probe 4 are installed so as to be orthogonal to each other. The distances between the probes 3 and 4 and between the probe 3 and the closed surface 1*a* are approximately ¼ of the guide wavelength. The dielectric feeder 2 is formed of a dielectric material, such as polyethylene. A holding portion 2*a* is formed in the middle of the dielectric feeder 2, and a radiation portion 2*b* and a conversion portion 2*c* are formed on either side of it. The outer diameter of the holding portion 2*a* is substantially the same as the inner diameter of the wave guide 1. By forcing the holding portion 2*a* into the open end portion of the wave guide 1, the dielectric feeder 2 is secured inside the wave guide 1. Both the radiation portion 2*b* and the conversion portion 2*c* have a conical configuration, and the radiation portion 2*b* protrudes externally from the open end of the wave guide 1, the conversion portion 2*c* extending into the interior of the wave guide 1.

The primary radiator, constructed as described above, is installed at the focal position of the reflecting mirror of a satellite receiving reflective antenna. A radio wave transmitted from the satellite converges at the dielectric feeder 2 and undergoes impedance matching before entering the wave guide 1. And, of the linearly polarized wave input to the wave guide 1, consisting of horizontally polarized wave and vertically polarized wave, the horizontally polarized wave is received by the first probe 3, and the vertically polarized wave is received by the second probe 4. The reception signal is frequency-converted into an IF frequency signal by a converter circuit (not shown) before being output.

Compared with a conical horn type primary radiator having a wave guide whose open end portion is flared, the conventional primary radiator using a dielectric feeder, constructed as described above, is advantageous in that a reduction in radial dimension can be achieved. However, due to the radiation portion 2*b* and the conversion portion 2*c* formed at either end of the dielectric feeder 2 and having a conical configuration, the total length of the dielectric feeder 2 is rather large. In particular, the conversion portion 2*c* extending into the wave guide 1 must be formed as a long cone in order to secure a satisfactory impedance matching with the wave guide 1. Further, the holding portion 2*a* forced into the wave guide 1 must be long enough to stabilize the dielectric feeder 2 inside wave guide 1, with the result that a reduction in the size of the primary radiator is prevented.

SUMMARY OF THE INVENTION

In accordance with the present invention, there is formed at the end surface of the holding portion secured to the inner surface of the wave guide a recess extending in the axial direction of the wave guide or a protrusion having a height of approximately ¼ of the wavelength of the radio wave. In this construction, the recess or the protrusion formed at the end surface of the holding portion functions as an impedance conversion portion, so that, in spite of the fact that a sufficient length is secured for the holding portion to stabilize the dielectric feeder, it is possible to reduce the total length of the dielectric feeder, making it possible to achieve a reduction in the size of the primary radiator.

In accordance with the present invention, there is provided a primary radiator comprising a wave guide having at one end an opening for introducing a radio wave, and a dielectric feeder held at the open end of the wave guide, wherein the dielectric feeder comprises a radiation portion protruding from the open end of the wave guide and a holding portion secured to the inner surface of the wave guide, a recess extending in the axial direction of the wave guide being formed at the end surface of the holding portion.

In this construction, the impedance matching of the wave guide and the dielectric feeder is effected in the recess extending inwardly from the end surface of the holding portion, so that it is possible to secure a sufficient length for the holding portion to stabilize the dielectric feeder, and reduce the total length of the dielectric feeder to achieve a reduction in the size of the primary feeder.

In the above construction, the recess may have a conical or a pyramid-like configuration tapering off toward the interior of the dielectric feeder. To reduce the depth of the recess, however, it is desirable to form it as a cylindrical hole having a depth of approximately ¼ of the wavelength of radio wave, or a stepped hole consisting of a plurality of continuously formed cylindrical holes having different diameters, the depth of each cylindrical hole approximately ¼ of the wavelength of radio wave. In this case, in each cylindrical hole, the phase of the radio wave reflected at the bottom surface and the open end of the cylindrical hole is reversed to be canceled, so that it is possible to substantially reduce the reflection component of the radio wave, and the impedance matching with the wave guide is effected satisfactorily.

There is no particular restriction to the number of recesses. However, when forming a single recess at the end surface of the holding portion, it is desirable for the recess to be matched with the position of the axial center of the wave guide. On the other hand, when forming a plurality of recesses at the end surface of he holding portion, it is desirable to provide the recesses in an annular arrangement around the axis of the wave guide, or provide the recesses symmetrically with respect to the axis of the wave guide.

In the above construction, when there are formed at the end surface of the radiation portion a plurality of annular grooves having a depth corresponding of ¼ of the wavelength of radio wave, it is possible to reduce the length of the radiation portion and further reduce the size of the primary radiator.

In accordance with the present invention, there is further provided a primary radiator comprising a wave guide having at one end an opening for introducing radio wave, and a dielectric feeder held at the open end of the wave guide, wherein the dielectric feeder includes a radiation portion protruding from the open end of the wave guide and a holding portion forced into the interior of the wave guide, a protrusion having a height of approximately ¼ of radio wave being formed at the end surface of the holding portion.

In this construction, the phase of the radio wave reflected at the protruding surface of the protrusion and the bottom surface is reversed to be canceled, so that the reflection component of the radio wave is substantially reduced and a satisfactory impedance matching with the wave guide is ensured, whereby it is possible to restrain the protruding amount of the protrusion functioning as the impedance conversion portion to reduce the total length of the dielectric feeder, thereby achieving a reduction in the size of the primary radiator.

In the above construction, there is no particular restriction to the number of protrusions. However, when forming a single protrusion at the end surface of the holding portion, it is desirable to match this protrusion with the position of the axis of this wave guide. On the other hand, when forming a plurality of protrusions at the end surface of the holding portion, a stepped protrusion consisting of a plurality of continuously formed cylindrical portions having different diameters is formed, the height of each cylindrical portion corresponding to approximately ¼ of the wavelength of radio wave.

DESCRIPTION OF THE PREFERRED EMBODIMENT

Figure 1:
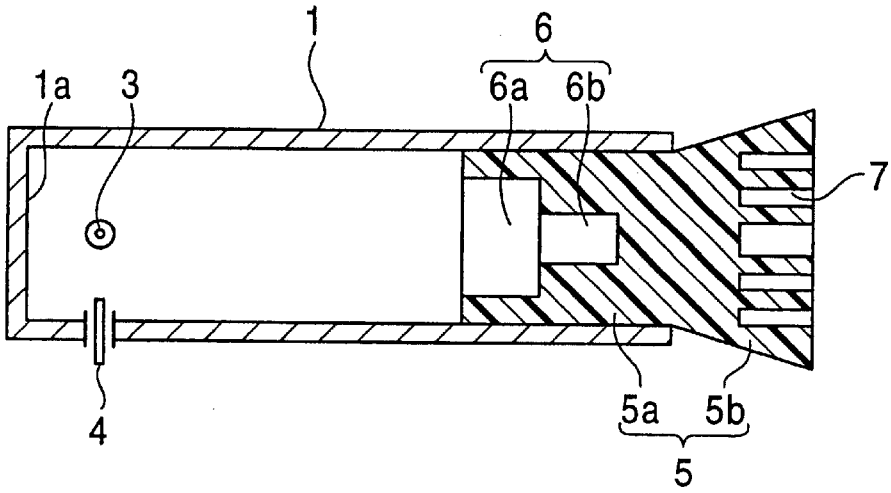
FIG. 1 is a sectional view of a primary radiator according to a first embodiment of the present invention.
Figure 2:
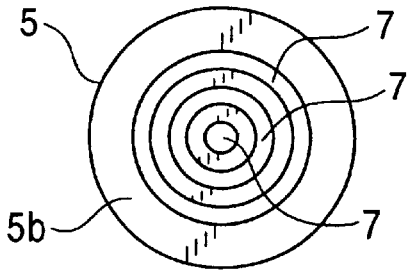
FIG. 2 is a right-hand side view of a dielectric feeder provided in the primary radiator.
Figure 3:
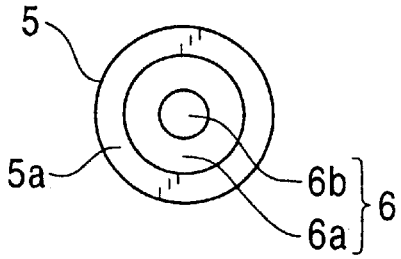
FIG. 3 is a left-hand side view of the dielectric feeder.
Figure 4:
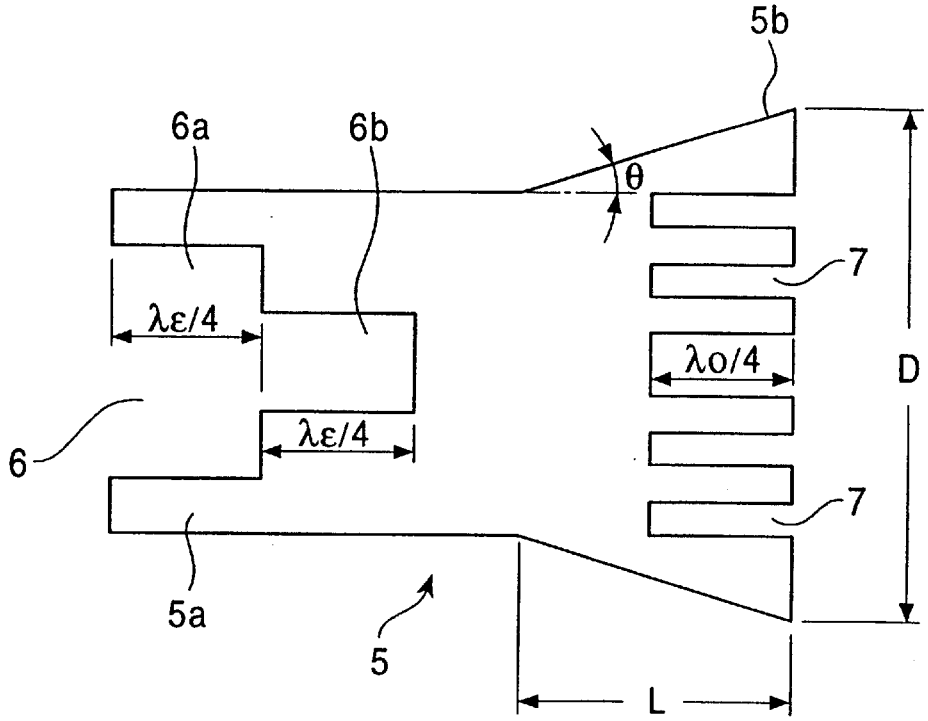
FIG. 4 is a schematic diagram illustrating the dielectric feeder.

Embodiments of the present invention will now be described with reference to the drawings. FIG. 1 is a sectional view of a primary radiator according to a first embodiment of the present invention; FIG. 2 is a right-hand side view of a dielectric feeder provided in the primary radiator; FIG. 3 is a left-hand side view of the dielectric feeder; and FIG. 4 is a schematic diagram illustrating the dielectric feeder.

As shown in these drawings, the primary radiator of this embodiment comprises a circular-sectioned wave guide 1 one end of which is open and the other end of which is formed as a closed surface 1*a*, and a dielectric feeder held at the open end of the wave guide 1, a first probe 3 and a second probe 4 being installed inside the wave guide 1 so as to be orthogonal to each other. The distances between the probes 3 and 4 and between the probe 3 and the closed surface 1*a* are approximately ¼ of the guide wavelength $\lambda g$, the probes 3 and 4 being connected to a converter circuit (not shown).

The dielectric feeder 5 is formed of a dielectric material having a low dielectric loss tangent. In this embodiment, polyethylene (dielectric constant $\epsilon$=2.25), which is inexpensive, is used in view of the price. The dielectric feeder 5 comprises a holding portion 5*a* having a recess 6 at one end, and a radiation portion 5*b* flared at the other end of the holding portion 5*a*, a plurality of annular grooves 7 being formed in the end surface of the radiation portion 5*b*. The outer diameter of the holding portion 5*a* is substantially the same as the inner diameter of the wave guide 1. By forcing the holding portion 5*a* into the open end of the wave guide 1, the dielectric feeder 5 is secured inside the wave guide 1. The recess 6 is a stepped hole consisting of a cylindrical portion 6*a* having a relatively large diameter and a cylindrical portion 6*b* continuously formed at the bottom of the cylindrical portion 6*a*, the depth of the cylindrical portions 6a and 6b being approximately ¼ of the wavelength $\lambda\epsilon$ of the radio wave propagated in the dielectric feeder 5.

The radiation portion 5*b* of the dielectric feeder 5 protrudes outwardly from the open end of the wave guide 1, and this radiation portion 5*b* is flared so as to make an angle $\theta$ with respect to the peripheral surface of the holding portion 5*a*. The annular grooves 7 are concentrically formed in the end surface of the radiation portion 5*b*, and the depth of the annular grooves 7 is approximately ¼ of the wavelength $\lambda_0$ of radio wave propagated through the air. The radiation portion 5*b* is a receiver of the radio wave reflected by the reflective mirror. To receive the radio wave efficiently, a predetermined directional angle is necessary for the radiation pattern of the radiation portion 5*b*. This radiation pattern is determined by the diameter D of the end surface of the radiation portion 5*b* and the length L of the radiation portion 5*b*. Assuming that the directional angle, $\theta$, of the radiation pattern is fixed, the diameter D and the length L are closely related to each other. The larger the angle $\theta$, the larger the diameter D of the end surface of the radiation portion 5*b*, and the smaller the length L of the radiation portion 5*b*. However, when the angle $\theta$ exceeds a critical angle, the radio wave entering through the end surface of the radiation portion 5*b* is allowed to be transmitted through the peripheral surface of the radiation portion 5*b*. Taking these facts into consideration, the range of the angle $\theta$ is set as follows:

$$0<\theta<\sin^{-1}(1/\sqrt{\epsilon}) \quad (1)$$

In this embodiment, polyethylene is used as the material of the dielectric feeder 5, and its dielectric constant $\epsilon$ is 2.25. By substituting the value of $\epsilon$=2.25 into formula (1), the following range of the angle $\theta$ is obtained: $0°<\theta<43.50$. Thus, by making the angle $\theta$ as large as possible within this range, it is possible to reduce the length L of the radiation portion 5*b*.

Next, the operation of this primary radiator, constructed as described above, will be described.

The radio wave transmitted from the satellite is collected by the reflective mirror of the antenna to reach the primary radiator. It enters the dielectric feeder 5 through the radiation portion 5*b* and converges. A plurality of annular grooves 7 are formed in the end surface of the radiation portion 5*b*, and the depth of the annular grooves 7 is approximately ¼ of the wavelength $\lambda_0$ of the radio wave propagated through the air, so that the phase of the radio wave reflected by the end surface of the radiation portion 5*b* and the bottom surface of the annular grooves 7 is reversed to be canceled, whereby there is practically no reflection component of radio wave directed to the radiation portion 5*b*, thereby making it possible to converge the radio wave efficiently on the dielectric feeder 5.

The radio wave entering through the radiation portion 5*b* is propagated through the dielectric feeder 5 and undergoes impedance matching with the wave guide 1 at the end surface of the holding portion 5*a*. In the end surface of the holding portion 5*a*, there is formed a recess 6 consisting of two cylindrical holes 6*a* and 6*b* continuously formed in a step-like fashion, and the depth of the cylindrical holes 6*a* and 6*b* is approximately ¼ of the wavelength $\lambda\epsilon$ of the radio wave propagated through the dielectric feeder 5, so that the radio wave reflected by the end surface of the holding portion 5*a* and the bottom surface of the small-diameter cylindrical hole 6*b* and the radio wave reflected by the bottom surface of the large-diameter cylindrical hole 6*a* undergo phase reversal to be canceled, whereby there is practically no reflection component of radio wave propagated through the dielectric feeder 5 and directed toward the interior of the wave guide 1, thereby making the impedance matching of the wave guide 1 and the dielectric feeder 5 satisfactory. And, of the linearly polarized wave consisting of a horizontally polarized wave and vertically polarized wave input to the wave guide 1, the horizontally polarized wave is received by the first probe 3 and the vertically polarized wave is received by the second probe 4, the reception signal being frequency-converted to an IF frequency signal by a converter circuit (not shown) and output.

In the first embodiment described above, the recess 6 formed in the end surface of the holding portion 5 functions as the impedance conversion portion, so that it is possible to reduce the total length of the dielectric feeder 5, making it possible to achieve a reduction in the size of the primary radiator. Further, the total length of the dielectric feeder 5 is not increased if a sufficient length is secured for the holding portion 5*a*, so that it is possible to stabilize the attitude of the dielectric feeder 5. Further, the recess 6 consists of a stepped hole composed of two cylindrical holes 6*a* and 6*b* continuously formed in a step-like fashion, and the depth of the cylindrical holes 6*a* and 6*b* is approximately ¼ of the wavelength $\lambda\epsilon$ of the radio wave propagated through the dielectric feeder 5, so that the radio wave reflected by the bottom surfaces of the cylindrical holes 6*a* and 6*b* and by the open end undergoes phase reversal to be canceled, whereby the impedance matching of the wave guide 1 and the dielectric feeder 5 is satisfactory.

Figure 5:
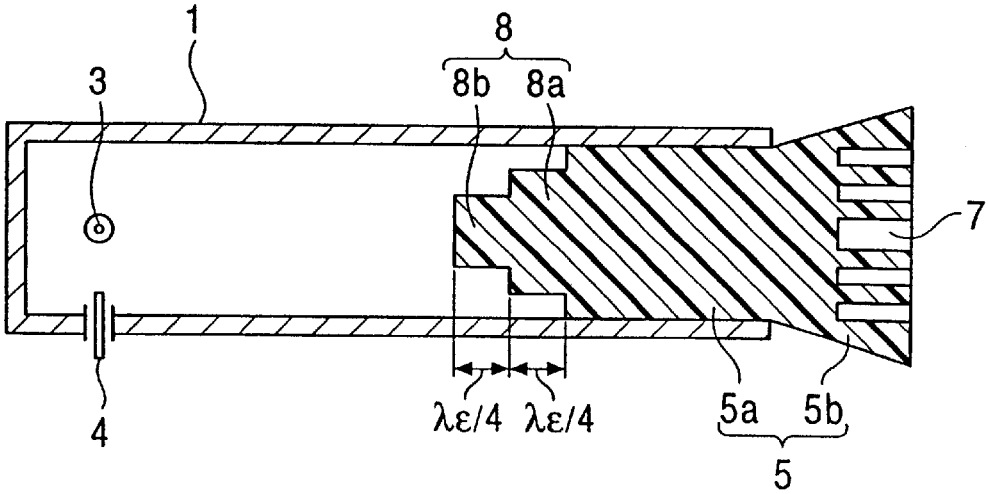
FIG. 5 is a sectional view of a primary radiator according to a second embodiment of the present invention.
Figure 6:
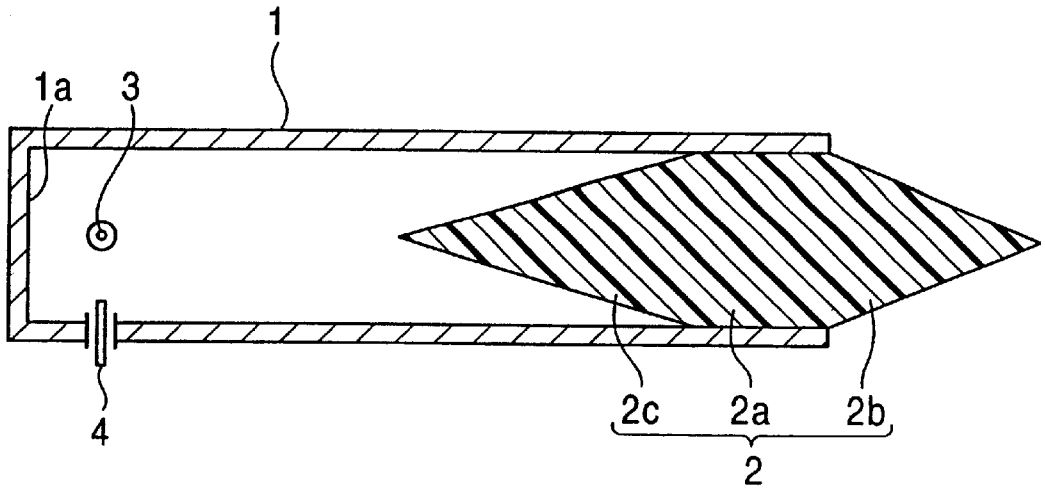
FIG. 6 PRIOR ART
FIG. 6 is a sectional view of a conventional primary radiator.

FIG. 5 is a sectional view of a primary radiator according to a second embodiment of the present invention, and the components corresponding to those of FIG. 1 are indicated by the same reference numerals.

The second embodiment differs from the first embodiment in that a protrusion 8 is formed on the end surface of the holding portion 5*a* instead of the recess. Apart from that, it has the same basic construction as the first embodiment. The protrusion 8 is a reversal of the recess 6, that is, it consists of a stepped protrusion composed of a large-diameter cylindrical portion 8*a* and a small-diameter cylindrical portion 8*b* protruding from the end surface of the large-diameter cylindrical portion 8*a*, and the height of the cylindrical portions 8*a* and 8*b* is approximately ¼ of the wave length $\lambda\epsilon$ of the radio wave propagated through the dielectric feeder 5. Thus, of the radio wave propagated through the dielectric feeder 5 and directed toward the end surface of the holding portion 5*a*, the radio wave reflected by the end surfaces of the cylindrical portions 8*a* and 8*b* and the bottom surface undergoes phase reversal to be canceled, so that there is practically no reflection component of radio wave propagated through the dielectric feeder 5, and the impedance matching of the wave guide 1 and the dielectric feeder 5 is satisfactory.

In the primary radiator, constructed as described above, the protrusion 8 formed on the end surface of the holding portion 5*a* functions as the impedance conversion portion, so that, although the effect is somewhat less remarkable than that of the first embodiment, it is possible to reduce the total length of the dielectric feeder 5 as compared to the prior art, making it possible to achieve a reduction in the size of the primary radiator.

The primary radiator of the present invention is not restricted to the above embodiments, and various modifications are possible. For example, it is possible to appropriately increase or decrease the number of steps of the recess or protrusion formed at the end surface of the dielectric feeder, to concentrically arrange the plurality of annularly formed recesses, or to scatter the plurality of recesses while maintaining the symmetricalness. Further, it is possible to change the configuration of the recesses to a conical or pyramid-like one, to change the sectional configuration of the recess or the protrusion to one other than circular, for example, a polygonal one, such as triangular or square, or to change the sectional configuration of the wave guide 1 and the holding portion 5*a* of the dielectric feeder 5 from the circular one to a rectangular one.

The present invention, described above, provides the following advantage.

In a primary radiator holding a dielectric feeder at the open end of a wave guide, when there is formed at the end surface of the holding portion secured to the inner surface of the wave guide a recess or a protrusion which extends in the axial direction of the wave guide and whose depth or height corresponds to approximately ¼ of the wavelength of radio wave, the recess or the protrusion functions as the impedance conversion portion, so that, although a sufficient length is secured for the holding portion to stabilize the attitude of the dielectric feeder, it is possible to reduce the total length of the dielectric feeder, making it possible to achieve a reduction in the size of a primary radiator.

What is claimed is:

1. A primary radiator comprising:

a wave guide having an open end for passing a radio wave having a first wavelength in free space; and a dielectric feeder positioned inside the open end of the wave guide, the dielectric feeder having a dielectric constant $\epsilon$, the radio wave having a second wavelength in the dielectric feeder, wherein the dielectric feeder comprises a radiation portion protruding from the open end of the wave guide and a holding portion secured inside the inner surface of the wave guide, said dielectric feeder including at least one recess at each end, the radiation portion flaring out from the holding portion at an angle $\theta$, where $$0 < \theta < \sin^{-1}\left(\frac{1}{\sqrt{\varepsilon}}\right).$$

2. The primary radiator of claim 1, wherein the at least one recess includes a conical recess tapering off toward the interior of the dielectric feeder.

3. The primary radiator of claim 1, wherein the at least one recess includes a pyramid-like recess tapering off toward the interior of the dielectric feeder.

4. The primary radiator of claim 1, wherein the at least one recess includes a cylindrical recess having a depth of approximately one-fourth of one of the first and second wavelengths of the radio wave.

5. The primary radiator of claim 1, wherein the at least one recess includes a stepped cylindrical recess having a plurality of cylindrical portions of different diameters, the depth of each cylindrical portion approximately one-fourth of one of the first and second wavelengths of the radio wave.

6. The primary radiator of claim 1, wherein said at least one recess includes a recess provided along the axis of the wave guide.

7. The primary radiator of claim 1, wherein said at least one recess is provided annularly around the axis of the wave guide.

8. The primary radiator of claim 7, wherein said at least one recess has a depth of approximately one-fourth of the first wavelength of the radio wave and is provided on an end side of the radiation portion.

9. The primary radiator of claim 1, wherein said at least one recess includes a plurality of recesses provided symmetrically with respect to the axis of the wave guide.

10. The primary radiator of claim 1, wherein said at least one recess has a depth of approximately one-fourth of the first wavelength of the radio wave and is provided on an end side of the radiation portion.

11. The primary radiator of claim 1, wherein said at least one recess has a depth of approximately one-fourth of the second wavelength of the radio wave and is provided on an end side of the holding portion.

12. A primary radiator comprising:

a wave guide having an open end for passing a radio wave having a first wavelength in free space; and a dielectric feeder positioned inside the open end of the wave guide, the radio wave having a second wavelength in the dielectric feeder, wherein the dielectric feeder includes a radiation portion protruding from the open end of the wave guide and a holding portion forced into the interior of the wave guide, said dielectric feeder including at least one protrusion having a height of approximately one-fourth of the second wavelength of the radio wave, said protrusion being formed at an end side of the holding portion.

13. The primary radiator of claim 12, wherein the at least one protrusion includes a stepped protrusion comprising a plurality of continuous portions of different size, the height of each portion approximately one-fourth of the second wavelength of the wavelength of the radio wave.

14. The primary radiator of claim 13, wherein the at least one protrusion includes a stepped cylindrical protrusion comprising a plurality of cylindrical portions of different diameters, the height of each cylindrical portion approximately one-fourth of the second wavelength of the wavelength of the radio wave.

15. The primary radiator of claim 14, wherein said at least one protrusion includes only one protrusion provided along the axis of the wave guide.

16. The primary radiator of claim 12, wherein the radiation portion flares out from the holding portion at an angle θ, where $$0 < \theta < \sin^{-1}\left(\frac{1}{\sqrt{\epsilon}}\right),$$

where ϵ is dielectric constant of the dielectric feeder.

17. The primary radiator of claim 12, wherein the radiation portion has at least one recess.

18. The primary radiator of claim 12, wherein each recess in the at least one recess has a depth of approximately one-fourth of the first wavelength of the radio wave.

19. A primary radiator comprising:

a wave guide having an open end to pass a radio wave, the radio wave having a first wavelength in free space; and a dielectric feeder positioned inside the open end of the wave guide, the radio wave having a second wavelength in the dielectric feeder, the dielectric feeder including a radiation portion protruding from the open end of the wave guide and a holding portion secured inside the inner surface of the wave guide, one end of the radiation portion including a first recess having a depth of approximately one-fourth of the first wavelength and one end of the holding portion including a second recess having a depth of approximately one-fourth of the second wavelength.

20. The primary radiator of claim 19, wherein the second recess includes one of a conical recess tapering off toward the interior of the dielectric feeder, a pyramid-like recess tapering off toward the interior of the dielectric feeder, a cylindrical recess, a polygonal recess, and a stepped cylindrical recess having a plurality of cylindrical portions of different diameters, the depth of each cylindrical portion approximately one-fourth of the second wavelength of the radio wave.

21. The primary radiator of claim 19, wherein one of the first and second recesses includes a recess provided along the axis of the wave guide.

22. The primary radiator of claim 19, wherein one of the first and second recesses is provided annularly around the axis of the wave guide.

23. The primary radiator of claim 19, wherein one of the first and second recesses includes a plurality of recesses provided symmetrically with respect to the axis of the wave guide.

24. The primary radiator of claim 19, wherein the radiation portion flares out from the holding portion at an angle θ, where $$0 < \theta < \sin^{-1}\left(\frac{1}{\sqrt{\epsilon}}\right),$$

where ϵ is dielectic constant of the dielectic feeder.

* * * * *